US005872420A

United States Patent [19]

Itoh et al.

[11] Patent Number: 5,872,420

[45] Date of Patent: Feb. 16, 1999

[54] DISPLAY APPARATUS HAVING SPACERS OF NON-ALKALI COMPONENT AND HYDROPHOBIC COATING

[75] Inventors: Shigeo Itoh; Tatsuo Yamaura; Yoshio Makita; Mamoru Namikawa, all of Mobara, Japan

[73] Assignee: Futaba Denshi Kogyo K.K., Mobara, Japan

[21] Appl. No.: 766,313

[22] Filed: Dec. 13, 1996

[30] Foreign Application Priority Data

Dec. 15, 1995 [JP] Japan ..... 7-347094

[51] Int. Cl.[6] ..... H01J 1/88

[52] U.S. Cl. ..... 313/292; 313/495

[58] Field of Search ..... 313/495, 292, 313/258, 309, 336, 496, 422; 445/24

[56] References Cited

U.S. PATENT DOCUMENTS 5,675,212 10/1997 Schmid et al. ..... 313/292

5,717,286 2/1998 Itoh et al. ..... 313/495

*Primary Examiner*—Sandra L. O'Shea

*Assistant Examiner*—Vip Patel

*Attorney, Agent, or Firm*—Oblon, Spivak, McClelland, Maier & Neustadt, P.C.

[57] ABSTRACT

A display apparatus capable of preventing deterioration in the light emission efficiency of a fluorescent member thereof, that of the emission performance of the emitter thereof and shortage of the life caused from the deterioration in the emission performance. The display apparatus according to the present invention has the structure such that each of insulating support rods for supporting an anode substrate and a cathode substrate in the container of the display apparatus has a glass fiber support rod body made of a non-alkali material and the surface of the support rod has a coating layer made of a hydrophobic material so as to prevent diffusion of alkali components and generation of oxygen from the insulating support rods.

12 Claims, 2 Drawing Sheets

DISPLAY APPARATUS HAVING SPACERS OF NON-ALKALI COMPONENT AND HYDROPHOBIC COATING

BACKGROUND OF THE INVENTION

1. Field of the Invention

The present invention relates to a display apparatus having a fluorescent member for displaying an image and the like and support rods disposed in a displaying envelope for accommodating an electron source for exciting the fluorescent member at a predetermined distance between an anode substrate and a cathode substrate disposed opposite to each other, and more particularly to a display apparatus having a field emission cathode.

2. Description of the Related Art

When an electric field of about $10^9$ V/m is applied to the surface of a metal or semiconductor member, a tunnel effect causes electrons to pass through a barrier so that electrons are discharged into a vacuum although it is under the normal temperature. The foregoing phenomenon is called "field emission" and is a known phenomenon. A cathode for discharging electrons by using the above-mentioned principle is called a field emission cathode.

In recent years, the use of techniques for micro-machining semiconductors enables the manufacture of a micro-sized field emission cathode. By forming a multiplicity of the field emission cathodes on a substrate, a surface emission type field emission array can be manufactured. A field emission array of the above-mentioned type has been suggested to be employed as an electron source of a display apparatus, a CRT, an electronic microscope, an electron beam apparatus and the like.

The cross sectional structure of a conventional display apparatus is shown in FIG. 1 as an example of an employment of the above-mentioned field emission array. The display apparatus shown in FIG. 1 has a structure such that a glass cathode substrate 10 having a field emission array and an anode substrate 4 having a fluorescent member and made of transparent glass are disposed opposite to each other so that an envelope capable of evacuating the inside thereof is formed.

The field emission array formed on the cathode substrate 10 is a spindt type field emission array including stripe-shaped cathode line electrodes 6 formed by sputtering or the like, a resistance layer 9 formed on the cathode line electrodes 6, an emitter cone group 7 formed on the resistance layer 9 and gate line electrodes 5 formed adjacent to the leading ends of the emitter cone group 7.

Note that an insulating layer 8 is laminated on the resistance layer 9, and the gate line electrodes 5 are formed on the insulating layer 8.

The pitch between the emitter cones of the emitter cone group 7 can be shortened to 10 microns or more. The emitter cones are formed on one cathode substrate 10 by tens to hundreds of thousands. Since the field emission array of the foregoing type enables the distance between the gate and the cathode to be shortened to a sub-micron value, electrons can be emitted from the emitter cone group 7 by applying voltage V of only tens of volts between the gate and the cathode.

The anode substrate 4 has the anode electrode 1 formed thereon, and a fluorescent dot pattern 2 is laminated on the anode electrode 1.

Therefore, when a positive voltage V is applied to the anode electrode 1, electrons emitted from the emitter cone group 7 are caught by the anode electrode 1. Electrons caught as described above conflict with the fluorescent dot pattern 2 laminated on the anode electrode 1 so that the fluorescent dot pattern 2 is excited. As a result, the fluorescent dot pattern 2 emits light. Light emission at this time can be observed through the anode substrate 4.

In the display apparatus having the above-mentioned structure, the inside of the envelope formed by the cathode substrate 10 and the anode substrate 4 is made to be under high vacuum. Since the cathode substrate 10 and the anode substrate 4 are sometimes impossible to maintain at a predetermined distance because of an influence of the atmosphere, a plurality of insulating support rods 3 are disposed between the cathode substrate 10 and the anode substrate 4.

Each insulating support rod 3 is made of an insulating material, for example, glass, the plurality of the insulating support rods 3 being disposed between the cathode substrate 10 and the anode substrate 4 at predetermined intervals.

The top end of the insulating support rod 3 is arranged to be in contact with the anode electrode 1 formed on the anode substrate 4, while the bottom end of the insulating support rod 3 is disposed in contact with a gate line electrodes 5 formed on the insulating layer 8 of the cathode substrate 10.

The plurality of stripe-shaped cathode line electrodes 6 formed on the cathode substrate 10 and the stripe-shaped gate line electrodes 5 formed perpendicularly to the cathode line electrodes 6 form a matrix. The matrix is scanned by a cathode scanning portion (not shown) and a gate scanning portion (not shown).

As a result, electrons are selectively emitted from the emitter cone group 7 in response to the image signal so that the fluorescent dot pattern 2 emits light. Thus, an image is displayed on the anode substrate 4.

In this case, for example, an image signal is supplied to the gate scanning portion so that one image is displayed on the anode substrate 4 when scanning of one field is completed.

It is preferable that the display apparatus having the above-mentioned structure has improved characteristics by minimizing factors which deteriorate the light emission efficiency of the fluorescent dot pattern 2 and emission performance of the emitter cone group 7, which shorten the life of the display apparatus.

SUMMARY OF THE INVENTION

In order to achieve the foregoing object, according to one aspect of the present invention, there is provided a display apparatus including: a cathode substrate having an electron source; an anode substrate having a light emission portion which is excited by electrons emitted from the electron source; and support rods disposed between the cathode substrate and the anode substrate in such a manner that the cathode substrate and the anode substrate are disposed opposite to each other at a predetermined distance, wherein the support rods are made of a glass material which does not contain an alkali component. Moreover, each of the support rods has a hydrophobic surface.

As mentioned above, support rods for supporting the cathode substrate and the anode substrate are made of glass materials which do not contain an alkali component so that the alkali component may not be diffused from supporting rods. Since the surface of the support rod is made to have the hydrophobic characteristic, water which is adsorbed by the surface of the support rod can be minimized. As a result, generation of oxygen which takes place when electron beams are applied from the electron source can be prevented.

Other objects, features and advantages of the invention will be evident from the following detailed description of the preferred embodiments described in conjunction with the attached drawings.

DESCRIPTION OF THE PREFERRED EMBODIMENTS

Figure 1:
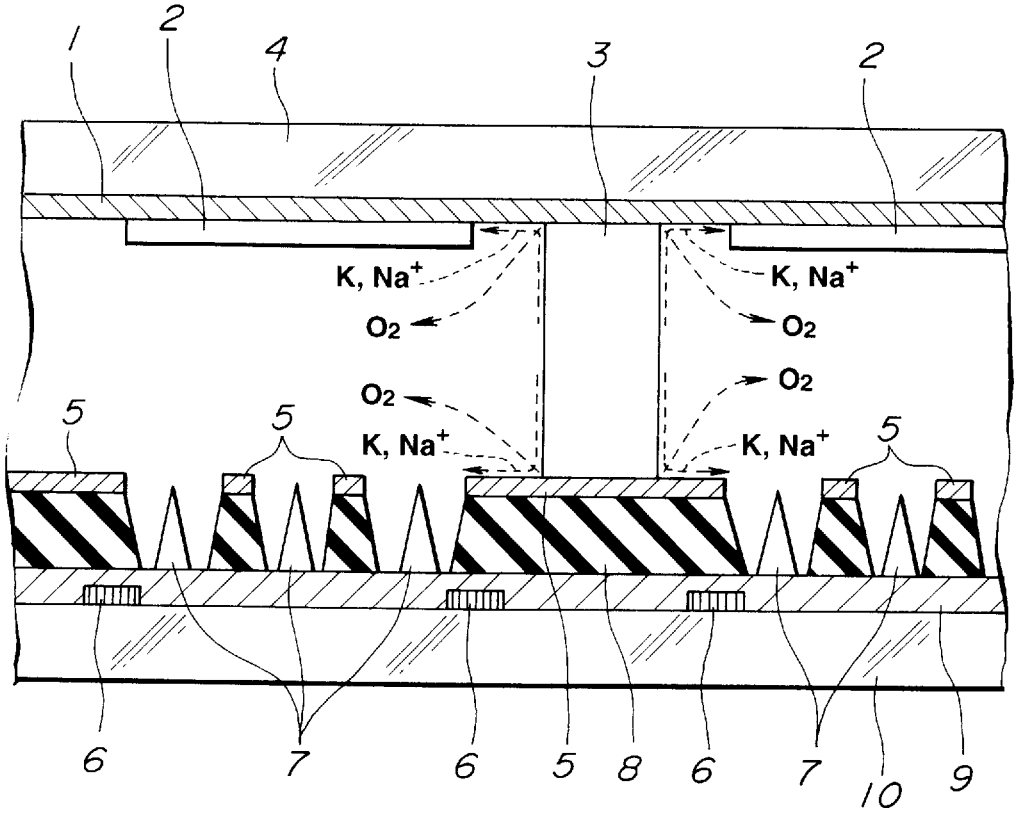
FIG.1 (PRIOR ART)
FIG. 1 is a side cross sectional view showing the structure of a conventional display apparatus.

Prior to describing the structure of the present invention, the particulars resulting in the need for the present invention will now be described. The insulating support rod 3 shown in FIG. 1 is manufactured by cutting, for example, a glass fiber, to have a predetermined length. The material of the glass fiber is usually borosilicate glass in view of easily obtaining the material.

The borosilicate contains alkali components, such as Na (sodium), K (potassium) and so forth.

When a display apparatus shown in FIG. 1 is manufactured by using the insulating support rod 3 made of the borosilicate, a phenomenon is confirmed that the alkali components included in the insulating support rod 3 are diffused onto the substrate around the insulating support rod 3 during the baking and the container sealing processes.

When the display apparatus is operated, a high voltage of about 400 V is sometimes applied to the anode electrode 1 shown in FIG. 1. The voltage, which is applied to the anode electrode 1, is also applied to the insulating support rod 3. A fact has been confirmed that this causes the alkali components in the insulating support rod 3 to be moved and diffused. The above-mentioned state is schematically shown by a dashed-line arrows in FIG. 1.

As described above, a fact has been found that when the alkali components diffused in the container of the display apparatus from the insulating support rod 3 reach, for example, the fluorescent dot pattern 2, the light emission efficiency of the fluorescent member is deteriorated. Accordingly, the phenomenon of the diffusion of the alkali components is required to be prevented in both the cases where the display apparatus is manufactured and where the display apparatus is operated. In particular, a color fluorescent member, such as $ZnGaO_4$:Mn, is considered to be considerably affected by the alkali components.

A fact has been known that the surface of the glass fiber forming the insulating support rod 3 has a hydrophilic characteristic, to which, for example, OH groups easily adhere. Therefore, the surface of the insulating support rod 3 is in a state where a large quantity of water has been adsorbed.

In a case where the display apparatus shown in FIG. 1 is structured into a graphic display capable of displaying a precise image, the distance from the insulating support rod 3 to the fluorescent dot pattern 2 is shortened to about 10 $\mu$m. If the display apparatus having the foregoing structure is operated, the insulating support rod 3 is also probably irradiated with electrons emitted from the emitter cone group 7. Thus, water adsorbed by the surface of the insulating support rod 3 is decomposed by the applied electron beams so that oxygen ($O_2$) is generated as indicated by the dashed-line arrows shown in FIG. 1. The foregoing phenomenon takes place considerably in the vicinity of the boundary between the insulating support rod 3 and the anode electrode 1 or the gate line electrodes.

A fact has been confirmed that specific types of gases adversely affect the emission characteristic of the field emission emitter (the emitter cone group 7). As one of the gases, oxygen has been considered. Oxygen unintentionally oxidizes the surface of the field emission emitter, thus causing the emission performance of the emitter to deteriorate. The oxidation of the field emission emitter results in the life of the display apparatus being shortened. Accordingly, the display apparatus structured as shown in FIG. 1 is also required to minimize the quantity of water which is adsorbed by the surface of the insulating support rod 3.

Although the surface area of each of the insulating support rod 3 is small, a display apparatus having a size of, for example, 10 cm×10 cm includes tens to thousands of insulating support rods 3. Therefore, the total area of the insulating support rods 3 is made to be a considerably large area. Therefore, inhibiting diffusion of the alkali component from the insulating support rods 3 and reducing water which is adsorbed by the surfaces of the insulating support rods 3 cause the total characteristics of the display apparatus shown in FIG. 1 to be improved considerably.

Figure 2:
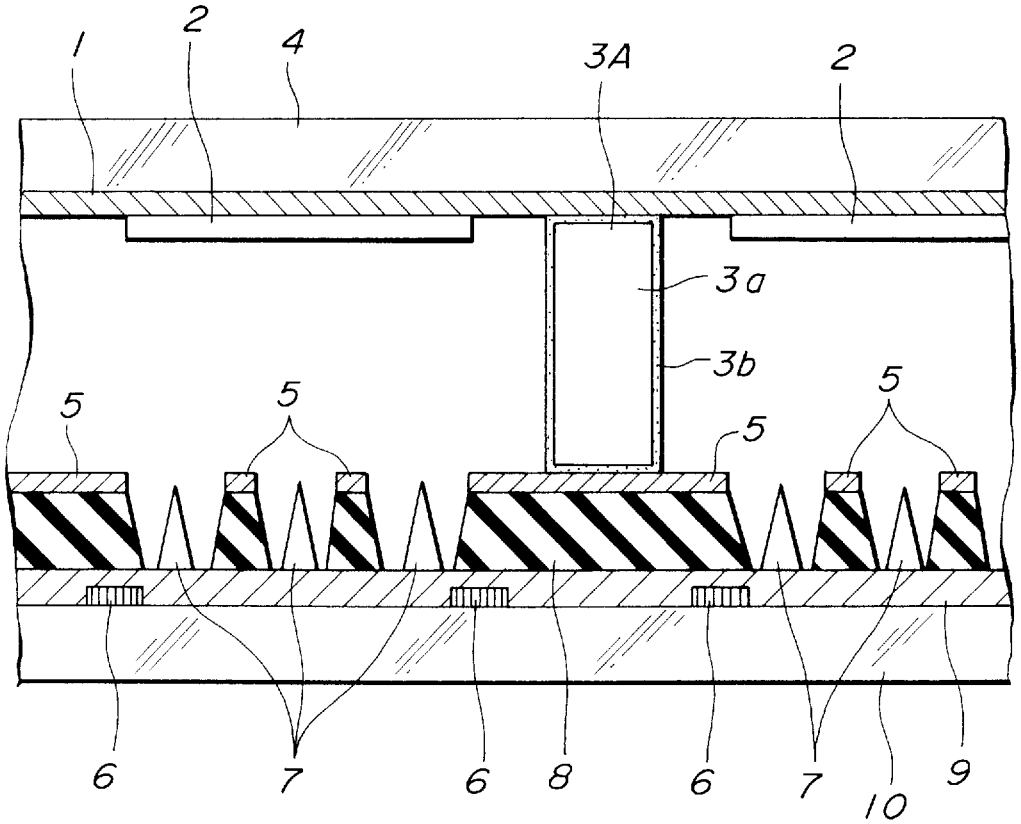
FIG. 2 is a side cross sectional view showing the structure of a display apparatus according to an embodiment of the present invention.

In view of the foregoing, the present invention was established. The cross sectional structure of the display apparatus according to an embodiment of the present invention is shown in FIG. 2. The same elements as those shown in FIG. 1 are given the same reference numerals and description of the same elements is omitted here.

The display apparatus shown in FIG. 2 has an insulating support rod 3A for supporting the cathode substrate and the anode substrate. A support rod body 3*a* of the insulating support rod 3A is made of non-alkali glass fiber which does not contain any alkali component. As the non-alkali component, for example, a quartz fiber or an E glass fiber, made of a type of borosilicate may be employed, each of which can relatively easily be obtained.

As a result, a generation of the alkali components which are diffused when the display apparatus is manufactured and when the display apparatus is operated can be prevented. Thus, deterioration in the light emission efficiency of the fluorescent dot pattern 2 can be prevented.

The support rod body 3*a* of the insulating support rod 3A according to this embodiment is applied with a coating layer 3*b* made of a hydrophobic film so that the quantity of water which is adsorbed by the surface of the insulating support rod 3A is reduced. As a result, a deterioration in the emission performance of the field emission emitter can be prevented and the life of the display apparatus can be lengthened.

As a material for forming the hydrophobic coating layer 3*b*, SiN (silicon nitride), Si (silicon) or $Cr_2O_3$ (chrome oxide) may be used because of insulating characteristic required for the insulating support rod 3A.

As a method of forming a coating layer 3*b* for the insulating support rod 3A, CVD (Chemical Vapor Deposition) may be employed in the case where SiN (silicon nitride) or Si (silicon) is employed to form the coating layer 3*b*. If $Cr_2O_3$ (chrome oxide) is employed, the sputtering method may be employed.

The present invention simply requires that the insulating support rod is made of the material which does not contain the alkali component and the surface of the insulating support rod has the hydrophobic characteristic. Therefore, the material of the glass fiber body and that of the coating layer of the insulating support rod may be changed to be adaptable to various conditions and therefore the materials are not limited to the foregoing embodiment.

Although the structure in which the present invention is applied to a field emission display apparatus has been described as the embodiment of the present invention, the present invention is not limited to this. For example, the present invention may be applied to a display apparatus, for example, a fluorescent display tube, in which the insulating support rods are disposed in an envelope thereof.

As described above, the present invention is structured such that the non-alkali component material is employed to form the support rod for internally supporting the vacuum envelope of the display apparatus so that deterioration in the light emission efficiency of the fluorescent member is prevented. Since the surface of the support rod is provided with the hydrophobic characteristic by coating the surface with the hydrophobic material, the generation of oxygen in the envelope can be prevented. As a result, the deterioration in the emission performance of, for example, the field emission device can be prevented and the life of the display apparatus can therefore be elongated.

Although the invention has been described in its preferred form with a certain degree of particularity, it is understood that the present disclosure of the preferred form can be changed in the details of construction and in the combination and arrangement of parts without departing from the spirit and the scope of the invention as hereinafter claimed.

What is claimed is:

1. A display apparatus, comprising:

a cathode substrate having an electron source;

an anode substrate having a light emission portion which is excited by electrons emitted from said electron source; and support rods disposed between said cathode substrate and said anode substrate in such a manner that said cathode substrate and said anode substrate are disposed opposite to each other at a predetermined distance, wherein said support rods are made of an alkali-component-free glass material.

2. A display apparatus, comprising:

a cathode substrate having an electron source;

an anode substrate having a light emission portion which is excited by electrons emitted from said electron source; and support rods disposed between said cathode substrate and said anode substrate in such a manner that said cathode substrate and said anode substrate are disposed opposite to each other at a predetermined distance, wherein each of said support rods has a hydrophobic surface.

3. A display apparatus, comprising:

a cathode substrate having an electron source;

an anode substrate having a light emission portion which is excited by electrons emitted from said electron source; and support rods disposed between said cathode substrate and said anode substrate in such a manner that said cathode substrate and said anode substrate are disposed opposite to each other at a predetermined distance, wherein each of said support rods is made of an alkali-component-free glass material and has a hydrophobic surface.

4. A display apparatus comprising:

a cathode substrate having an electron source;

an anode substrate having a light emission portion which is excited by electrons emitted from said electron source; and a plurality of support rods having a core composed of an E-Glass fiber made of a type of borosilicate and disposed between said cathode substrate and said anode substrate.

5. A display apparatus according to claim 4, wherein at least one of said plurality of support rods comprises a hydrophobic surface.

6. A display according to claim 4, wherein said cathode substrate and said anode substrate are disposed opposite to each other at a predetermined distance.

7. A display apparatus comprising:

a cathode substrate having an electron source;

an anode substrate having a light emission portion which is excited by electrons emitted from said electron source; and a plurality of support rods having a core composed of a quartz fiber made of a type of borosilicate and disposed between said cathode substrate and said anode substrate.

8. A display according to claim 7, wherein at least one of said plurality of support rods comprises a hydrophobic surface.

9. A display according to claim 7, wherein said cathode substrate and said anode substrate are disposed opposite to each other at a predetermined distance.

10. A display apparatus comprising:

a cathode substrate having an electron source;

an anode substrate having a light emission portion which is excited by electrons emitted from said electron source; and a plurality of support rods having a core composed of an alkali-component-free fiber and disposed between said cathode substrate and said anode substrate.

11. A display according to claim 10, wherein at least one of said plurality of support rods comprises a hydrophobic surface.

12. A display according to claim 10, wherein said cathode substrate and said anode substrate are disposed opposite to each other at a predetermined distance.

* * * * *